United States Patent [19]

Kalve

[11] 4,050,582

[45] Sept. 27, 1977

[54] SEALED ENVELOPE ASSEMBLY WITH LOCKING POCKETS FOR FREE INSERT MATERIAL

[75] Inventor: Uldis H. Kalve, Lisle, Ill.

[73] Assignee: Wallace Business Forms, Inc., Hillside, Ill.

[21] Appl. No.: 713,539

[22] Filed: Aug. 11, 1976

[51] Int. Cl.[2] ..... B65D 27/34

[52] U.S. Cl. ..... 206/627; 206/628; 206/629; 229/DIG. 14; 282/11.5 A; 282/25

[58] Field of Search ..... 40/158 R; 229/69, 85, 229/DIG. 14; 282/11.5 R, 11.5 A, 25

[56] References Cited

U.S. PATENT DOCUMENTS

| | | | |
|---|---|---|---|
| 1,381,674 | 6/1921 | Simpson | 40/158 |
| 2,148,886 | 2/1939 | Wanser | 229/69 |
| 2,164,655 | 7/1939 | Kleerup | 88/26 |
| 2,257,766 | 10/1941 | Sherman | 282/3 |
| 2,532,132 | 11/1950 | Vogel | 40/158 R X |
| 2,633,284 | 3/1953 | Moffett et al. | 229/DIG. 14 |
| 2,842,882 | 7/1958 | Greene et al. | 40/158 |
| 3,104,799 | 9/1963 | Steidinger | 229/69 |
| 3,186,735 | 6/1965 | Hanrahan | 282/25 |
| 3,214,083 | 10/1965 | Jury | 229/69 |
| 3,339,827 | 9/1967 | Steidinger | 229/69 |
| 3,437,259 | 4/1969 | Steidinger | 229/69 |
| 3,552,641 | 1/1971 | Bell et al. | 229/69 |
| 3,554,438 | 1/1971 | Van Malderghem | 229/69 |
| 3,704,015 | 11/1972 | Holovka et al. | 270/52 |
| 3,777,971 | 12/1973 | Steidinger | 229/69 |
| 3,937,395 | 2/1976 | Lawes | 229/DIG. 14 |
| 3,941,308 | 3/1976 | DiGirolono et al. | 229/69 |

*Primary Examiner*—Stephen P. Garbe

*Attorney, Agent, or Firm*—Neuman, Williams, Anderson & Olson

[57] ABSTRACT

This improved sealed envelope assembly with locking pockets for free insert material comprises an envelope with front and back plies and at least one insert ply therebetween. The envelope has internal securing means such as adhesive lines adjacent the peripheral edges of the front and back plies for uniting the same, the securing means being spaced from the periphery of the insert ply so that the insert ply lies wholly within the enclosure bounded by the securing means. The back ply has a plurality of spaced embossments located inwardly of the securing means and adjacent the periphery of the insert ply, preferably on at least two sides, each of the embossments comprising a tab having a base portion preferably integrally secured to the back ply along a substantially straight deflection line and a free portion deflected towards the front ply in substantial overlapping relationship with the insert ply so as to form, in conjunction with the back ply, a locking pocket for the insert ply. Lines of weakening in the front and back plies are located along one side inwardly of the deflection lines whereby separation of the plies along the lines of weakening removes a marginal portion of the plies, opens said envelope assembly and frees the insert ply from the locking pockets so that it can be readily removed.

12 Claims, 6 Drawing Figures

FIG. 3
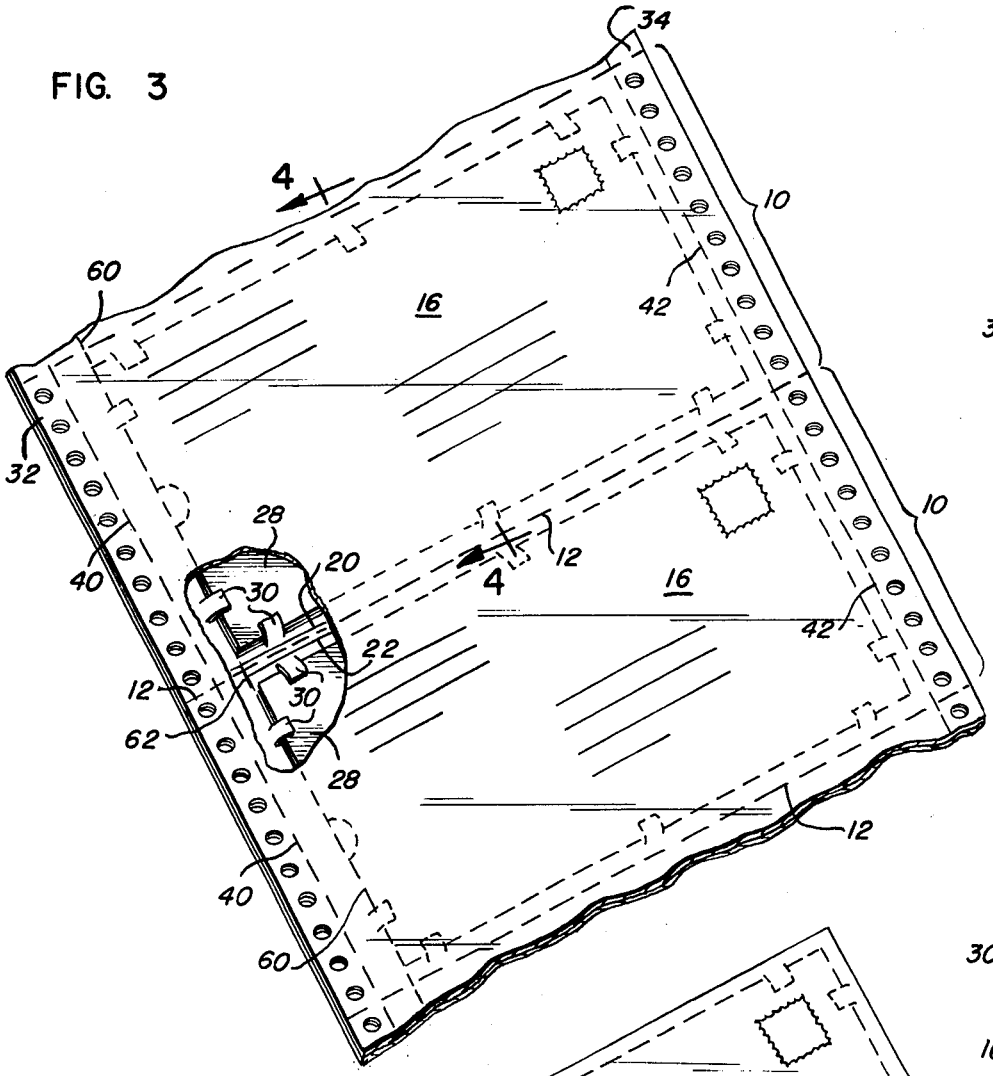
FIG. 4
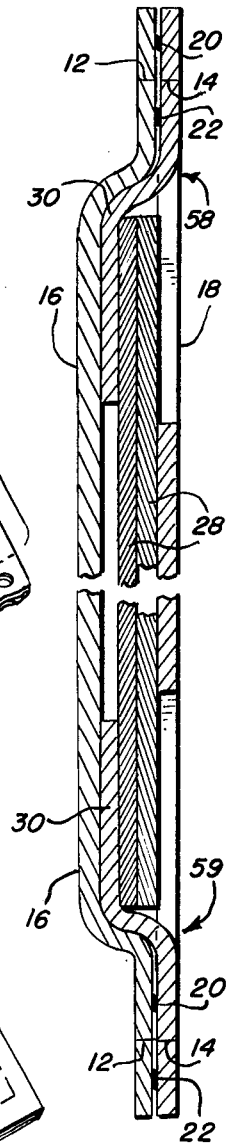
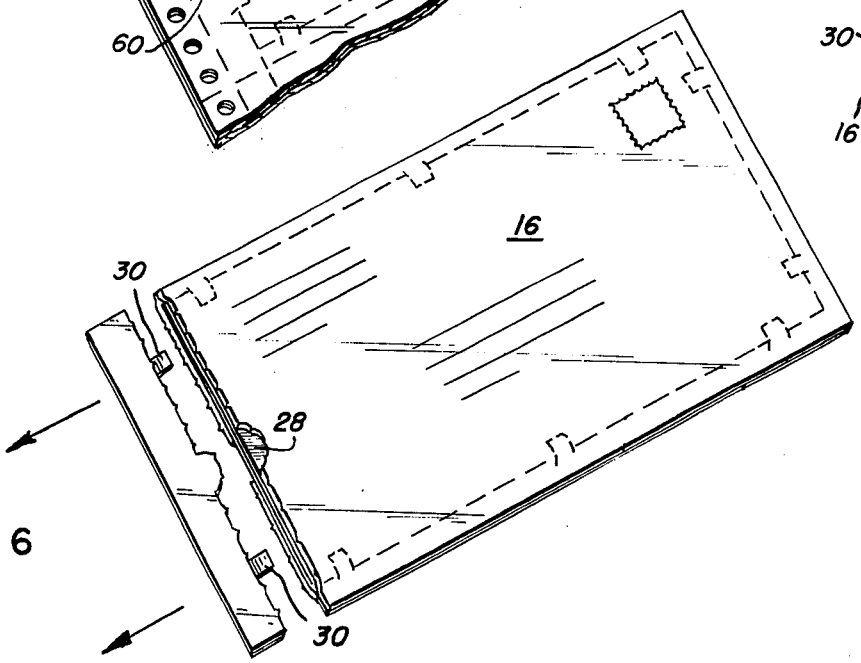
FIG. 6

SEALED ENVELOPE ASSEMBLY WITH LOCKING POCKETS FOR FREE INSERT MATERIAL

BACKGROUND OF THE INVENTION

1. Field of the Invention

This invention relates to continuous form stationery comprising stuffed sealed envelope assemblies of the type which are manually or automatically processed on computers or other business machines by the typing or printing of information on selected plies thereof. More particularly, it relates to the improvement over the invention disclosed in U.S. Pat. Nos. 3,777,971 and 3,830,141 issued to Donald J. Steidinger on Dec. 11, 1973 and Aug. 20, 1974, respectively.

While the present invention is described herein with reference to particular embodiments, it should be understood that the invention is not limited thereto. The envelope assembly of the present invention may be employed in a variety of forms, as those skilled in the art will recognize in the light of the present disclosure.

2. Description of the Prior Art

Presealed envelope assemblies of the type contemplated herein are well known in the prior art and are presently receiving extensive commercial acceptance. Representative of the prior art are such U.S. Pat. Nos. as Wanser 2,148,886, Sherman 2,257,766, Steidinger 3,104,799, Hanrahan 3,186,735, Steidinger 3,339,827, Steidinger 3,437,259, Bell 3,552,641, Van Malderghem 3,554,438, the aforementioned Steidinger 3,777,971 and 3,830,141, and DiGirolomo 3,941,308 and the various patents cited therein.

A requirement common to such types of stuffed sealed envelopes is the need for maintaining registration of the insert ply relative to the external plies so that indicia typed, printed or otherwise applied to the external ply for reproduction on an internal ply will be properly located within predetermined tolerances. This problem is aggravated by the high speed processing of the forms on modern business machines, such as automatic typewriters, billing and addressing machines, high speed printers associated with computers, and the like. Unless the insert plies are substantially immobilized relative to the external plies, the bending, flexing and substantial acceleration and deceleration to which the assemblies are subjected can cause excessive displacement of the insert plies to the point where subsequently added indicia are misplaced on the insert ply or plies, causing misalignment, misregistration and/or overprinting with consequent confusion, misreading, and aesthetically unacceptable results.

One prior art technique for immobilizing the insert ply is to attach or otherwise secure at least one margin of the insert plies to one or both of the external plies. For certain purposes, this approach is considered disadvantageous or otherwise undesired. For example, for certain uses it requires that the addressee trim or detach the insert plies from the external plies — an extra and inconvenient step and one which can result in tearing of the insert material.

The use of free insert plies, that is, plies which are not attached to the external plies in any way, avoids this problem and is a feature of the aforementioned Steidinger U.S. Pat. Nos. 3,777,971 and 3,830,141. The insert plies are maintained in substantial registration by means of embossments in the form of upraised portions or projections relative to the envelope back which are positioned within the perimeter defined by the perimetric lines of glue. Movement of the insert is effectively limited within specifications by abutment of the insert against the embossments.

In practice, however, unanticipated problems have arisen. If the embossments are not properly formed at the outset, consistent abutment may not occur and an insert ply or plies may wedge past the embossment into a misregistered position. Even if properly formed at the outset, mishandling of the forms or subjecting them to excessive pressures may cause flattening or other deformation of the embossments, resulting in the same problem.

Moreover, multiple and excessively-thick insert plies necessitate the presence of unduly large embossments or bumpers and may require special handling or complicate the manufacturing procedures. Furthermore, under certain circumstances the entire front ply may be removed from the sealed envelope during an automatic opening operation. The upraised embossments are thereby rendered ineffectual for holding or maintaining the insert ply in registration on the back ply.

OBJECTS OF THE INVENTION

It is therefore a general object of the present invention to provide a stuffed sealed envelope assembly which copes with the aforementioned and other problems associated with prior-art structures. It is another general object to provide a stuffed sealed envelope assembly featuring free insert material and improved means for maintaining registration thereof. It is another general object to provide improved means for maintaining the registration of free insert plies in a stuffed sealed envelope assembly of the type disclosed in the aforementioned U.S. Pat. Nos. 3,777,971 and 3,830,141.

It is a specific object to provide means for positively and accurately locking free insert material in a stuffed sealed envelope so as to maintain registration thereof regardless of the nature of the subsequent processing or handling. It is another specific object to provide means for immobilizing free inserts within a stuffed sealed envelope which is effective regardless of the number of insert plies or the thickness thereof. It is another specific object to provide immobilization means for free insert material in a stuffed sealed envelope which is handling-proof and pressure-proof.

It is another specific object to provide restraint means for free insert material in a stuffed sealed envelope which retains the insert material on one ply irrespective of the removal of the other ply. It is still another specific object of the present invention to retain free insert material in an accurate and positive manner within a stuffed sealed envelope by means which are readily removed upon opening of the envelope. It is another specific object to provide a locked, free insert envelope assembly wherein the free insert material is unlocked and the envelope is opened in a one-step manipulation.

These and other objects of the present invention will become apparent from the descriptions hereinafter set forth.

SUMMARY OF THE INVENTION

These objects are achieved in a particularly advantageous embodiment by a stuffed sealed envelope assembly comprising front, back and intermediate insert plies, the front and back plies being adhered or otherwise secured together adjacent the peripheral edges to form a generally sealed assembly. The adhesive means, e.g., lines or stripes of adhesive, and the insert ply are spaced apart whereby the insert ply lies wholly within the enclosure of the envelope bounded by the adhesive means without being attached thereto or in contact therewith.

The back ply features a plurality of unique, spaced embossments located inwardly of the adhesive means and adjacent the periphery of the insert ply. Each of the embossments comprises a tab or tongue or similar projection having a base portion preferably integrally secured to the back ply along a substantially straight deflection line and a free portion deflected towards and aligned with the front ply in substantial overlapping relationship with the insert ply so as to form a locking pocket therefor. The insert ply is positively and accurately retained in desired registration with the envelope during machine processing thereof by the locking pockets so formed.

In a typical embodiment, the envelope and insert material which may comprise one or more plies are generally rectangular in configuration and the back ply has matching embossments on at least two opposite sides. In a preferred embodiment the embossments are present on all four sides of the back ply whereby the insert plies are restrained in all four directions. In all such cases, the spacing between the innermost extremities of the free portion of the tabs forming the matching embossments on two sides is less than the corresponding dimension of the insert ply. In general, the relationship of the spacing between the bottoms or bases of the opposed locking pockets on each side and the size of the insert ply depends upon the amount of movement of the insert ply which is tolerable for registration purposes.

The free portion of the tabs making up the embossments may be curvilinearly configured, e.g., generally semicircular, or rectilinearly configured, e.g., generally triangular, rectangular or square, or a combination thereof. In a preferred embodiment the tab is rectilinearly configured, e.g., a rectangle defined by the three free sides cut from the back ply and the deflection line or bottom of the locking pocket which remains integrally attached to the back ply. The inwardly disposed length of the tab is such as will assure substantial overlapping of the insert material. Substantial overlapping of the insert is achieved by sizing the tab so that the overlapping portion thereof is no less than about 1/16 inch. In practice, the inwardly-disposed length of the tab should also be related to the total thickness of the insert plies so that it is no less than about three times the total thickness of the insert plies whereby the overlapping portion of the tabs is at least about twice the thickness, but not less than about the aforementioned 1/16 inch. In a preferred embodiment the length of the tabs is even greater, e.g., at least about four times the ply thickness, optimally about five to fifty times the thickness, to assure the desired substantial overlap and constraint.

In an advantageous and preferred embodiment, at least the back ply has a line of weakening, such as a series of perforations, disposed sufficiently inwardly of the deflection line or area of attachment of the embossments to the back ply whereby separation of the back ply along the line of weakening will remove the corresponding embossments and free the insert ply from the locking pockets formed thereby. Typically, both front and back plies have corresponding lines of weakening whereby separation of the plies along the lines of weakening opens the envelope and frees the insert ply from the corresponding locking pockets in a convenient one-step operation.

In still another specific embodiment, the insert plies may have different sizes, and separate embossments or locking pockets are provided for the different sizes. Manifestly, the smaller insert plies must be adjacent the back ply for such purposes.

BRIEF DESCRIPTION OF THE DRAWINGS

The present invention will be more clearly understood from the following detailed description of specific and preferred embodiments read in conjunction with the accompanying drawings wherein:

FIG. 3 is a fragmentary and partially cutaway view of a series of envelopes having the construction of FIGS. 1 and 2 but illustrated in assembled form;

FIG. 4 is a section view on an enlarged scale along line 4—4 of FIG. 3;

FIG. 6 shows a single envelope assembly of the type illustrated in FIGS. 1–4, but in the form received by the addressee and illustrates how the opening thereof along corresponding lines of weakness in the front and back plies also automatically unlocks the locking tabs from the insert plies.

It should be understood that the drawings are not necessarily to scale and that the illustrated embodiments are in some respects represented by symbols, diagrammatic representations and fragmentary and cutaway views for ease of understanding. In the exploded views, for example, lines have been added to show the relationship of the various plies. In the description of the elements making up the present invention herein, it should also be understood that the terminology "front", "back", "top", "bottom", "side" and the like are to be considered and interpreted as relative terms. Manifestly, envelopes can be reversed in either direction and the elements reversed in relation to each other. The description should be interpreted broadly, as those skilled in the art will recognize.

DETAILED DESCRIPTION OF THE DRAWINGS, INCLUDING PREFERRED EMBODIMENTS

Figure 1:
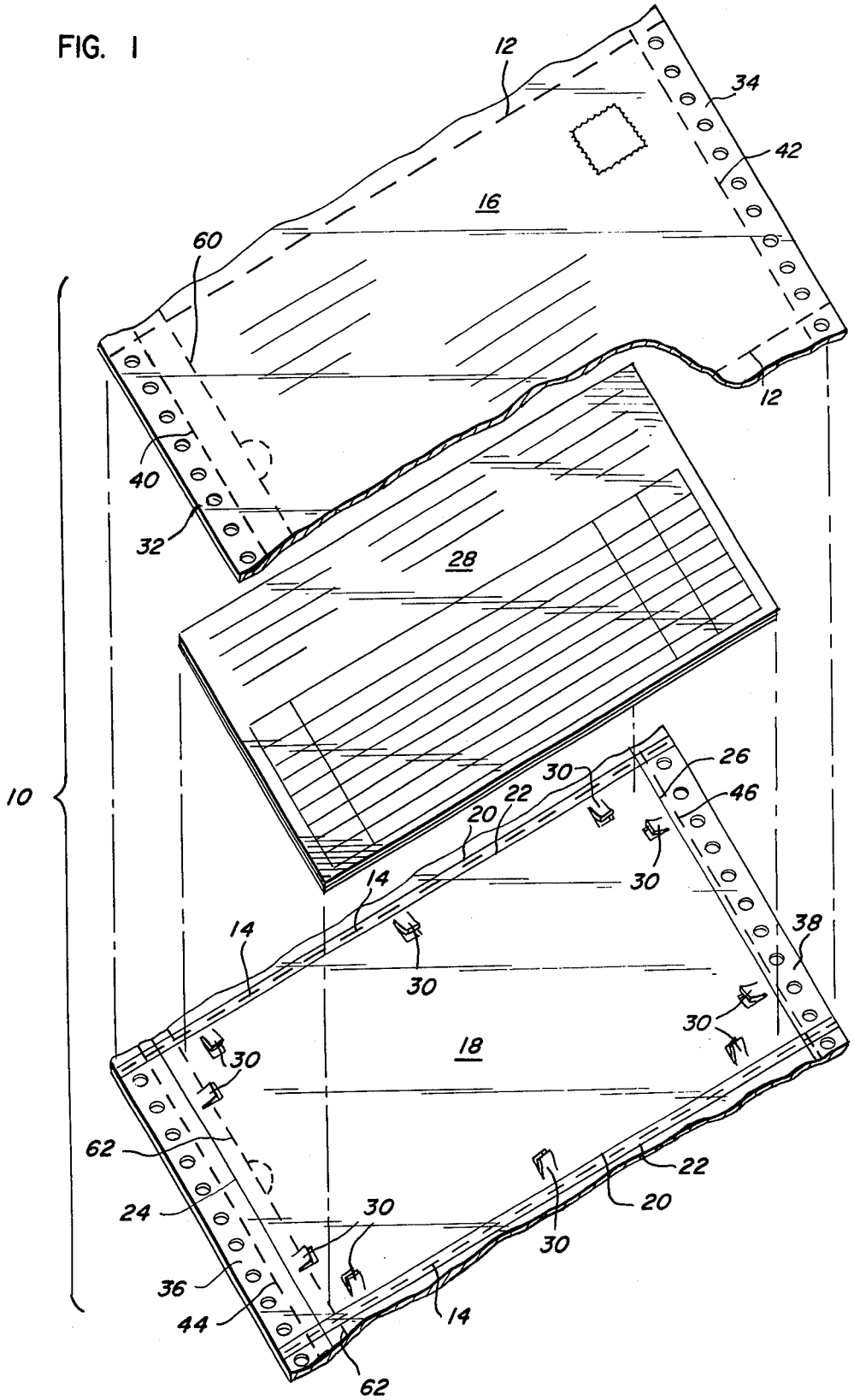
FIG. 1 is a fragmentary and partially cutaway view of a single envelope assembly of the present invention exploded to show separately the top, bottom and free insert intermediate plies.
Figures 2, 5:
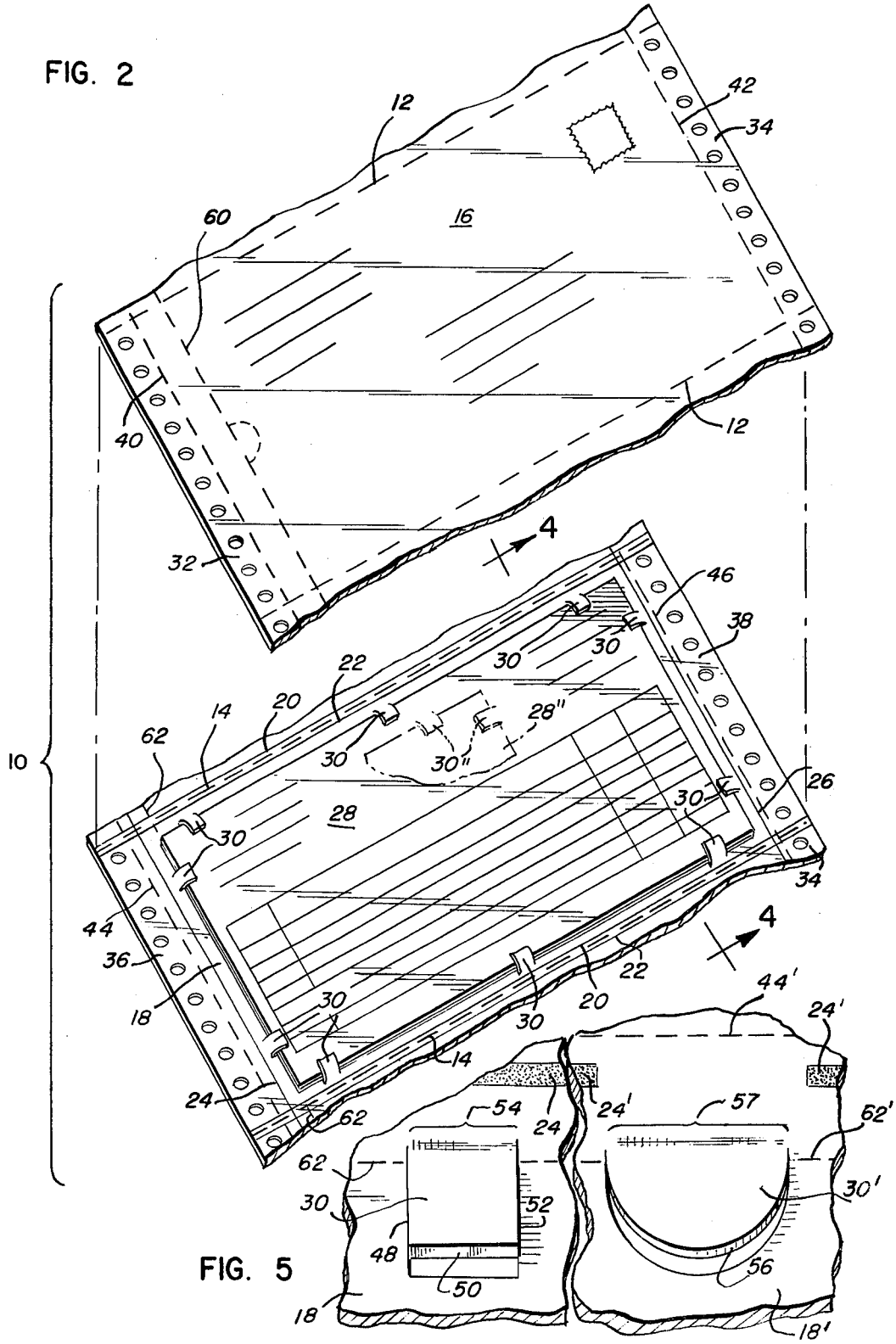
FIg. 2 is a fragmentary view similar to FIG. 1 except that the insert plies are illustrated in locked position within the tab-type embossmments, another embodiment of the invention also being illustrated in phantom lines thereon.
FIG. 5 is a fragmentary view on an enlarged scale of rectangular and curvilinear embodiments of locking tabs or tongues which may be advantageously employed in the practice of the present invention.

Referring to FIGS. 1, 2 and 3 together, the envelope assembly of the present invention consists of a series of individual envelopes 10 which are interconnected by lines of weakening, e.g., perforation lines 12 and 14, transverse the front and back plies 16 and 18, respectively. Perforation lines 12 and 14 are adjacent one another and provide a means of separating the individual envelopes 10 after the addressing or other processing thereof by conventional business machine techniques.

Top ply 16 and bottom ply 18 are adhered together along transverse adhesive means, i.e., glue lines 20 and 22, and longitudinal adhesive means, i.e., glue lines 24 and 26, to form an envelope for insert material 28, the edges of which are spaced from the adjacent glue lines. The insert material 28 may comprise a single sheet or a plurality of sheets, including return envelopes or the like. Insert material 28 is immobilized in spaced relation from glue lines 20, 22, 24 and 26 by means of tongues or tabs 30 which form locking pockets therefor, as more fully described hereinafter.

Top and bottom plies 16 and 18 have control punching strips 32, 34, 36 and 38 on the respective sides thereof to provide for registration during fabrication and/or other processing. Lines of perforation 40, 42, 44 and 46 run along each side between the registration holes in strips 32, 34, 36 and 38 and glue lines 24 and 26 to provide an easy and convenient method of removing the control punching strips after processing. In practice, still another ply normally overlies the assembly and provides a record of the indicia typed or otherwise applied thereto during processing. The overlying ply is releasably secured to control punching strips by means of perforations, indentations or other conventional techniques. It is removed after processing and prior to mailing and is not shown in the drawings because it is of conventional design and well known to those skilled in the art.

In the embodiment of FIGS. 1–3, embossments 30 comprise rectangular tabs free on three sides and integrally secured to back ply 18 along a substantially straight deflection line. This is illustrated in the magnified sectional view of FIG. 4 and the magnified fragmentary view of a single tab of FIG. 5 (left portion), wherein rectangular tab 30 is defined by a free portion having free sides 48, 50 and 52 and a substantially straight deflection line or area 54. The free portion of the tabs may also have a curvilinear configuration as illustrated in FIG. 5 (right side) wherein tab 30′ in back ply 18′ has a semicircular free portion defined by free edge 56 and a substantially straight deflection line 57.

While the term "lines" is used in connection with both the "glue lines" and the "deflection lines", it should be understood, of course, that the respective "lines" have a substantial area. This is indicated, for example, by the magnified cross-sectional views of glue lines 20 and 22 of FIG. 4 and glue line 24 of FIG. 5. Similarly, the deflection lines actually refer to a deflection area where tab 30 is bent or flexed inwardly from the back ply towards the front ply, as indicated at arrowheads 58 and 59 in FIG. 4. The term "substantially straight" as used in connection with the deflection lines means that the deflection lines as viewed from overhead (i.e., perpendicular to the back ply) are approximately straight and usually parallel to the insert edge being restrained or the adjacent line of adhesive. The straightness of the bend or deflection assures a large contact area at the base of the locking pockets (more pocket contact per unit cut), whereby any tendency of the edge of the insert material or individual plies thereof to cut or tear the pocket, particularly adjacent the deflection line, is minimized.

In FIG. 4 it will be noted that tabs 30 have an inwardly disposed length substantially in excess of the thickness of the plies 28, which are locked in place by the locking pockets formed by tabs 30 and back ply 18. To assure the requisite substantial overlap so that insert material 28 is securely held by tabs 30, the tabs should be, as aforementioned, at least about three times the thickness of the insert material as measured from the deflection line to the free end, whereby the equivalent of about one thickness is used in forming the base of the locking pocket and the equivalent of at least about two thicknesses is in overlapping relationship with marginal areas of insert material 28 to form the inner wall of the locking pocket, which should otherwise be no less than about 1/16 inch. An advantage of the present invention is that, unlike the problem of forming and maintaining abutting-type embossments to retain various thicknesses of inserts, the overlapping type embossments can be readily lengthened or shortened to accommodate almost any thickness by simply cutting a longer or shorter free portion, as required.

FIG. 4 also illustrates how, in contrast with prior art abutting-type embossments, the application of pressure to outer plies 16 and 18 increases the locking capabilities of the overlapping-type embossments 30 by causing them to more tightly grip the insert plies. In prior art embodiments, substantial pressure can deform or flatten the abutting-type embossments whereby, upon release of the pressure, they no longer span the gap between the front and back plies and may permit an insert ply or plies to slip by during further handling or processing thereof. In short, the present invention has converted the pressure-prone deficiency in the prior art structure to a locking-enhancement asset.

While the embodiment illustrated in the drawings features a plurality of locking pockets 30 on all four sides of the insert material 28, it may not be necessary for certain uses to provide four-way protection. It has been found, for example, that because of the peculiarities of certain printers or other machines on which the envelope assemblies are processed, the insert material may consistently be shifted in a particular direction or directions. Accordingly, if the insert material is constrained in that particular direction or directions, locking pockets need not be provided in the other directions. Similarly, if the insert material is such that it makes no difference if it shifts in one or more directions, protection in those directions may be omitted. In preferred embodiments, however, particularly where the tendency and direction of potential insert shifting is not predeterminable, four-way locking pockets are provided so that the envelope assemblies can be processed in any manner on any machines without causing undesired misregistration in any direction.

To facilitate opening envelope assemblies 10, lines of weakening are provided along one side of both front ply 16 and back ply 18, e.g., perforation lines 60 and 62. Manifestly, perforation lines 60 and 62 must be located inwardly of glue line 24 so that the glue line is also removed upon separation of the plies along the perforations. This relationship is apparent in the drawings.

In a highly advantageous embodiment, also illustrated in the drawings, perforation line 62 (line 62′ in FIG. 5) is located inwardly of the deflection line of the locking pockets 30 whereby separation of the back ply 18 along the perforation line 62 results in the removal of the adjacent locking tabs. The result is illustrated in FIG. 6, wherein removal of the marginal portion of the plies along perforation lines 60 and 62 opens the envelope assembly, removes locking tabs 30 from the opened side of the assembly envelope and exposes insert material 28 for convenient removal. Since the insert material 28 is not otherwise confined or restrained in the direction indicated by the arrowheads in FIG. 6, it can be slid out of the envelope without any need for removing marginal portions of the back and front plies therefrom, or for snapping the insert material loose or for otherwise subjecting the insert material to undesired stresses which could cause tearing.

While not illustrated in the drawings, perforation lines may be provided on either or both margins of the envelope assembly, whereby it can be opened and the locking embossments removed from either side. In still other embodiments, again not illustrated, perforation lines may be provided on three margins or all margins. This contrasts with certain prior art structures which can't be opened from more than one side because of the structural nature thereof.

In another embodiment of the present invention, insert material having a variety of sizes and shapes, including irregularly shaped inserts, may be incorporated within the envelope assembly and securely locked therein during processing and yet may be removed therefrom in the convenient fashion above described. This is indicated in dashed outline in FiG. 2 (lower portion) wherein, for example, a small postcard 28" is included with the much larger insert material 28 which is confined by locking tabs 30. Postcard 28" is held in place by auxiliary locking tabs 30" along two sides, the remaining sides (not shown) being confined by tabs 30. Using the principle illustrated, insert materials of various sizes and configurations can be restrained within desired specifications. Manifestly the smaller of the inserts must be disposed adjacent the back ply so that the innermost tabs can engage the same.

Another embodiment of the invention is illustrated in FIG. 5 (right side) wherein glue line 24', which is located inwardly of line of perforation 44', is discontinuous adjacent tabs 30'. This has the advantage of assuring that undesired squeegeeing or splashing of the glue will not interfere with the operation or function of the tabs. The discontinuities in the glue lines also have the advantage of providing escape passages for entrapped air or other gases which otherwise may cause undesired ballooning or puffing of the envelope — particularly during high speed processing.

While in the illustrated embodiments the plies of the envelope are secured together by glue lines, other means may also be employed. It should be recognized, for example, that the plies can be formed by folding a larger sheet on itself whereby at least along one side the plies are held together by the integral fold line.

The cutout portions or holes in the back ply corresponding to the locking embossments may have an additional utilitarian function not directly related to the objects of the present invention. Addressees, who receive large volumes of mail, occasionally use automatic machines for opening the envelopes. Certain machines utilize apertures or other openings for insertion of the opening mechanism. One or more of the tab-forming apertures of the present invention may be used for such purpose. Likewise, the tab-forming apertures on any side of the back ply are usually in alignment, providing in effect a line of weakness for ease of opening therealong.

From the above description it is apparent that the objects of the present invention have been achieved. While only certain embodiments have been set forth, alternative embodiments and various modifications will be apparent from the above description to those skilled in the art. For example, while tabs 30 in the drawings are integrally formed, they may also comprise discrete or separate tabs of the same or different sheet material, outer portions of which are secured to the underlying back ply by conventional securing means. Such means may include, for example, adhesives similar to those used to adhere the top and bottom plies together or pressure-sensitive or heat-activated adhesives. The means may also include, for example, fusion bonding, e.g., employing thermoplastic tabs and heat bonding the contacting portion to a thermoplastic underlying back ply or to the fibers of an underlying conventional back ply such as paper, or the like. These other alternatives are considered within the spirit and scope of the present invention.

Having described the invention, what is claimed is:

1. A stuffed, sealed envelope assembly comprising an envelope having front and back plies and at least one insert ply between said front and back plies, said envelope having lines of adhesive adjacent the peripheral edges of said front and back plies for uniting said front and back plies to form a generally sealed assembly, said lines of adhesive being spaced from the periphery of said insert ply so that said insert ply lies wholly within the enclosure of said envelope bounded by said lines of adhesive, said back ply having a plurality of spaced embossments located inwardly of said lines of adhesive and adjacent the periphery of said insert ply, each of said embossments comprising a tab having a base portion integrally secured to said back ply along a substantially straight deflection line and a free portion deflected towards said front ply in substantial overlapping relationship with said insert ply so as to form a locking pocket therefor, said insert ply being maintained in desired registration within said envelope during machine processing by such locking pockets, said lines of adhesive being discontinuous, the discontinuities therein occurring at least adjacent said embossments, said front and back plies having corresponding lines of weakening disposed inwardly of the deflection lines of said embossments along at least one side of said envelope whereby separation of the plies along the lines of weakening opens said envelope assembly and frees said insert ply from the locking pockets along said one side.

2. The envelope assembly of claim 1 wherein said embossments are disposed adjacent opposite peripheral edges of said insert ply, the spacing of the innermost extremities of the free portion of the tabs being less than the corresponding dimension of said insert ply.

3. The envelope assembly of claim 1 wherein said embossments comprise tabs cut from said back ply and deflected along said deflection line towards said front ply.

4. The envelope assembly of claim 3 wherein the free portions of said tabs are rectilinearly configured.

5. The envelope assembly of claim 3 wherein the free portions of said tabs are curvilinearly configured.

6. The envelope assembly of claim 1 wherein each edge of said insert ply has at least one embossment positioned adjacent thereto.

7. The envelope assembly of claim 1 wherein the free portions of said tabs have an inwardly disposed length no less than about three times the thickness of the insert ply and overlap the insert ply by no less than about 1/16 inch.

8. The envelope assembly of claim 1 including a plurality of insert plies of different size and separate embossments forming locking pockets for each different size of insert ply.

9. A stuffed, sealed envelope assembly comprising an envelope having front and back plies and at least one insert ply between said front and back plies, said envelope having internal adhesive means adjacent the peripheral edges of said front and back plies for uniting said front and back plies to form a generally sealed assembly, said adhesive means being spaced from the periphery of said insert ply so that said insert ply lies wholly within the enclosure of said envelope bounded by said adhesive means, said back ply having a plurality of spaced embossments located inwardly of said adhesive means and adjacent opposite peripheral edges of said insert ply, each of said embossments comprising a rectangular tab having a base portion integrally secured to said back ply along a substantially straight deflection line and a three-sided free portion cut from said back ply and deflected towards said front ply in substantial overlapping relationship with said insert ply so as to form a locking pocket therefor, the spacing between the innermost extremities of the free portion of opposed tabs being less than the corresponding dimension of said insert ply, said insert ply being maintained in desired registration within said envelope during machine processing by the locking pockets, said adhesive means being discontinuous, the discontinuities therein occurring at least adjacent said embossments, said front and back plies each including a line of weakening disposed inwardly of the deflection lines of said embossments along one side of said envelope whereby separation of the plies along the lines of weakening removes a marginal portion of the plies, frees the insert ply from the locking pockets on the removed marginal portion, and opens said envelope assembly.

10. A stuffed, sealed envelope assembly comprising an envelope having front and back plies and at least one insert ply between said front and back plies, said envelope having internal lines of adhesive adjacent the peripheral edges of said front and back plies for uniting said front and back plies to form a generally sealed assembly, said lines of adhesive being spaced from the periphery of said insert ply so that said insert ply lies wholly within the enclosure of said envelope bounded by said lines of adhesive, said back ply having a plurality of spaced tabs located inwardly of said lines of adhesive and adjacent opposite peripheral edges of said insert ply, each of said tabs comprising a base portion secured to said back ply and a free portion deflected towards said front ply in overlapping relationship with said insert ply so as to form a locking pocket therefor, the spacing between the innermost extremities of the free portion of opposed tabs being less than the corresponding dimension of said insert ply, said insert ply being maintained in desired registration within said envelope during machine processing by such locking pockets, said lines of adhesive being discontinuous, the discontinuities therein occurring at least adjacent said tabs, said front and back plies each including a line of weakening disposed inwardly of the deflection lines of the tabs along one side of said envelope whereby separation of the plies along the lines of weakening removes a marginal portion of the plies, opens said envelope assembly and frees said insert ply from the locking pockets on the removed marginal portion.

11. The envelope assembly of claim 10 wherein each of said tabs, as defined by the deflection line and the free edges of said free portion, is rectangular.

12. A stuffed, sealed envelope assembly comprising an envelope having front and back plies and at least one insert ply between said front and back plies, said envelope having internal adhesive means adjacent the peripheral edges of said front and back plies for uniting said front and back plies to form a generally sealed assembly, said adhesive means being spaced from the periphery of said insert ply so that said insert ply lies wholly within the enclosure of said envelope bounded by said adhesive means, said back ply having a plurality of spaced embossments located inwardly of said adhesive means and adjacent opposite peripheral edges of said insert ply, each of said embossments comprising a rectangular tab having a base portion integrally secured to said back ply along a substantially straight deflection line and a free portion cut from said back ply and deflected towards said front ply in substantial overlapping relationship with said insert ply so as to form a locking pocket therefor, the spacing between the innermost extremities of the free portion of opposed tabs being less than the corresponding dimension of said insert ply, said insert ply being maintained in desired registration within said envelope during machine processing by such locking pockets, said adhesive means being discontinuous, the discontinuities therein occurring at least adjacent said tabs, said front and back plies each including a line of weakening disposed inwardly of the deflection lines of the embossments along one side of said envelope whereby separation of the plies along the lines of weakening removes a marginal portion of the plies, opens said envelope assembly and frees said insert ply from the locking pockets on the removed marginal portion.

* * * * *